US008746636B2

(12) United States Patent
Rauchut

(10) Patent No.: US 8,746,636 B2
(45) Date of Patent: Jun. 10, 2014

(54) MIXING STAND FOR VISCOUS BUILDING MATERIALS

(76) Inventor: Michael J. Rauchut, North Wales, PA (US)

( * ) Notice: Subject to any disclaimer, the term of this patent is extended or adjusted under 35 U.S.C. 154(b) by 337 days.

(21) Appl. No.: 12/931,585

(22) Filed: Feb. 4, 2011

(65) Prior Publication Data

US 2011/0198457 A1 Aug. 18, 2011

Related U.S. Application Data

(60) Provisional application No. 61/337,928, filed on Feb. 12, 2010.

(51) Int. Cl.
*A47G 23/02* (2006.01)
*B01F 15/00* (2006.01)

(52) U.S. Cl.
CPC ..... *B01F 15/00733* (2013.01)
USPC ..... 248/146; 366/349

(58) Field of Classification Search
CPC ..... B01F 15/00733; B65F 1/141
USPC ..... 248/152–154, 146–147, 312.1, 346.03, 248/346.07, 346.5; 220/630, 737, 694, 628, 220/752, 636, 668, 729; 366/349, 129, 197, 366/215, 209, 605
See application file for complete search history.

(56) References Cited

U.S. PATENT DOCUMENTS 983,473 A * 2/1911 Barnes ..... 248/154
1,326,086 A * 12/1919 Ormandy ..... 248/311.2
1,464,652 A * 8/1923 Green ..... 248/145.6
2,017,319 A * 10/1935 McMullen ..... 248/312.1
2,501,895 A * 3/1950 Gayle ..... 248/146
2,673,053 A * 3/1954 Casimer ..... 248/153
3,276,733 A * 10/1966 Rosser ..... 248/146
3,313,423 A * 4/1967 Anders ..... 211/85.19
4,084,701 A * 4/1978 White ..... 211/81
4,877,208 A * 10/1989 Kennard, Jr. ..... 248/146
5,839,602 A * 11/1998 Mowry ..... 220/737
6,021,987 A * 2/2000 Shimota ..... 248/311.2
6,361,001 B1 * 3/2002 Durand ..... 248/146
7,018,090 B2 * 3/2006 Moore ..... 366/197
7,178,766 B2 * 2/2007 Forshee et al. ..... 248/146
7,258,312 B2 * 8/2007 Grosse ..... 248/154
7,494,103 B1 * 2/2009 Huebner ..... 248/346.07
7,540,462 B1 * 6/2009 Beden ..... 248/346.03
7,726,621 B1 * 6/2010 Dellinger ..... 248/346.5

(Continued)

*Primary Examiner* — Terrell McKinnon
*Assistant Examiner* — Ingrid M Weinhold
(74) *Attorney, Agent, or Firm* — Armand M. Vozzo, Jr.

(57) ABSTRACT

A mixing stand device is disclosed for holding a conventional bucket container of a viscous building material in a proper stationary position for mixing. The present mixing stand device comprises a rigid frame assembly erected and attached upon a base platform in a position that allows a worker to stand upon the platform forward of the frame assembly. The frame assembly is formed having an inwardly tapered cylindrical configuration that is fitted to receive the bucket container, the frame assembly comprising upper and lower circular band members spaced apart and coaxially disposed at the respective top and bottom of the frame assembly with a plurality of leg members each being laterally disposed at 90° to the other and extending between the upper and lower band members. Leg members disposed on opposite sides of the frame assembly are formed having an extended tab projecting above the upper band member that align with and engage a pocket formed on either side of the bucket container for the working handle to prevent rotation of the container when seated within the frame assembly.

4 Claims, 5 Drawing Sheets

(56) References Cited

U.S. PATENT DOCUMENTS

| | | | | |
|---|---|---|---|---|
| 2003/0016586 | A1* | 1/2003 | Williams | 366/349 |
| 2003/0189873 | A1* | 10/2003 | Moore | 366/349 |
| 2005/0045780 | A1* | 3/2005 | Forshee et al. | 248/146 |
| 2006/0124808 | A1* | 6/2006 | Hibbler | 248/146 |
| 2006/0202093 | A1* | 9/2006 | Grosse | 248/146 |
| 2007/0076519 | A1* | 4/2007 | Kesling | 366/129 |
| 2007/0252051 | A1* | 11/2007 | Kuipers | 248/146 |
| 2007/0280043 | A1* | 12/2007 | Cintorino | 366/215 |
| 2008/0042035 | A1* | 2/2008 | Elwood | 248/346.03 |
| 2009/0256034 | A1* | 10/2009 | Poyner | 248/154 |

* cited by examiner

MIXING STAND FOR VISCOUS BUILDING MATERIALS

CROSS-REFERENCE TO RELATED APPLICATION

This application is a continuation-in-part of provisional patent application Ser. No. 61/337,928 filed Feb. 12, 2010 for Mixing Stand for Viscous Building Materials.

BACKGROUND OF THE INVENTION

The present invention relates to an apparatus for supporting a bucket-type container of a relatively viscous material that requires mixing and, more particularly, to an improved mixing stand for holding a bucket container of viscous building material in a safe and stationary position so that a worker may effectively mix the material in the bucket as needed before its use.

In construction projects, many types of liquid building materials require mixing on the work site before the materials can be used and applied. These liquid building materials, which include plaster, grout, mortar, spackling compounds and other coating and sealing materials, are relatively viscous in nature and typically supplied to the work site and stored there in bucket-like cylindrical containers of plastic. Typically, the bucket containers for these materials are standard in their cylindrical configuration and are made available in conventional three and five gallon (seven and nineteen liter) sizes, each having essentially the same diameter. Regardless of whether these liquid building materials have been premixed in their containers, a thorough mixing is usually required before use to homogenize the components that may have separated over time or to mix in an added ingredient needed before the material is applied. On the worksite, it is common and most effective to mix the liquid building material directly in the bucket containers in which they are supplied so as to avoid the difficult task of transferring the materials to a separate mixing container and the consequent risk of spillage.

Because of the relatively high viscosity of these liquid building materials, especially after being stored for an extended period of time, the use of a powered mixing unit including an electric drill with a mixing attachment adapted to insert into the container is needed to facilitate the difficult task of mixing the viscous material and effectively homogenize its components without fatiguing the worker. While the powered mixing unit facilitates the task, it does generate a significant torque that induces a rotation of the container during mixing which tends to reduce the efficiency of the mixing operation, increasing the time and effort required to mix the material. The resulting torque may even cause the bucket container to inadvertently tip over and spill the material contents. To minimize the torque movement and rotation of the bucket container during the power mixing, containers have been placed in position to be gripped manually between a user's feet and legs or have been retained in such a position by means of mechanical devices.

The manual method of preventing movement and rotation has proven to be very difficult and somewhat hazardous for the worker to accomplish especially with the bucketed material being mixed immediately beneath his torso and between his legs. As a result, a variety of mechanical devices have been conceived and developed for retaining the bucket container during mixing and have included belts, braces, clamps and combinations thereof along with the incorporation of friction surfaces that are designed to seat or partially jacket the container in order to resist rotation. A few examples of these prior art mechanical retainer devices designed for mixing bucketed materials are found in U.S. Pat. No. 4,877,208 to Kennard, Jr.; U.S. Pat. No. 6,464,184 to Lytle; U.S. Pat. No. 6,779,915 to Foster, Jr.; U.S. Pat. No. 6,942,191 to Zagorsky; U.S. Pat. No. 7,178,766 to Forshee et al.; and U.S. Pat. No. 7,261,262 to Dunson. While these and other prior art devices have been generally satisfactory in retaining bucket containers of selected materials of lesser viscosity, there are limitations found in the prior art devices that make them less than suitable for mixing highly viscous materials, such as spackling compounds. The clamping features of some of the prior art bucket retainer devices are found to provide insufficient torque resistance for the more viscous materials that need mixing on the job site, while others that do provide adequate anti-rotational clamping, require the worker to stand in an unsafe position immediately over the bucket container with his feet straddling the material while power mixing. This positioning of the worker immediately over the bucket container while power mixing its contents is one prone to serious injury and harm to the worker. Therefore, a need exists for an improved device for securing a bucket container of viscous building material in a safe and stationary position so that a worker may effectively and thoroughly mix the material in the bucket as needed.

SUMMARY OF THE INVENTION

Accordingly, it is a general purpose and object of the present invention to provide an improved bucket retainer device for allowing a construction worker to safely and effectively mix all types of viscous building materials as needed for proper application of the materials at work sites.

A more particular object of the present invention is to provide an improved mixing stand device for holding a bucket container of viscous building material in a safe and stationary position so that a worker may effectively mix the material in the bucket as needed before its application.

Another object of the present invention is to provide an improved mixing stand device that safely positions a conventional bucket container on a worksite secured against rotation so that building material within the container may be effectively mixed by a worker with a powered mixing unit.

Still another object of the present invention is to provide an improved mixing stand device that is portable around a worksite and easy to implement by a worker.

A still further object of the present invention is to provide an improved mixing stand for bucketed building materials that is safe and simple to use, rugged in construction and inexpensive to maintain.

Briefly, these and other objects of the present invention are accomplished by an improved mixing stand device for holding a conventional bucket container of a viscous building material in a proper stationary position for mixing. The present mixing stand device comprises a rigid frame assembly erected and attached upon a base platform in a position that allows a worker to stand upon the platform forward of the frame assembly. The frame assembly is formed having an inwardly tapered cylindrical configuration that is fitted to receive the bucket container, the frame assembly further comprising upper and lower circular band members spaced apart and coaxially disposed at the respective top and bottom of the frame assembly with a plurality of leg members each being laterally disposed at 90° to the other and extending between the upper and lower band members. Leg members disposed on opposite sides of the frame assembly are formed having an extended tab projecting above the upper band member that align with and engage a pocket-like cavity formed on either side of the bucket container for the working handle to prevent rotation of the container when seated within the frame assembly. In an alternate embodiment, the upper band member is made semi-circular at the top of the frame assembly to facilitate movement of the bucket container to and from the frame assembly particularly when the container is filled with the viscous material.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DESCRIPTION OF THE INVENTION

Figure 1:
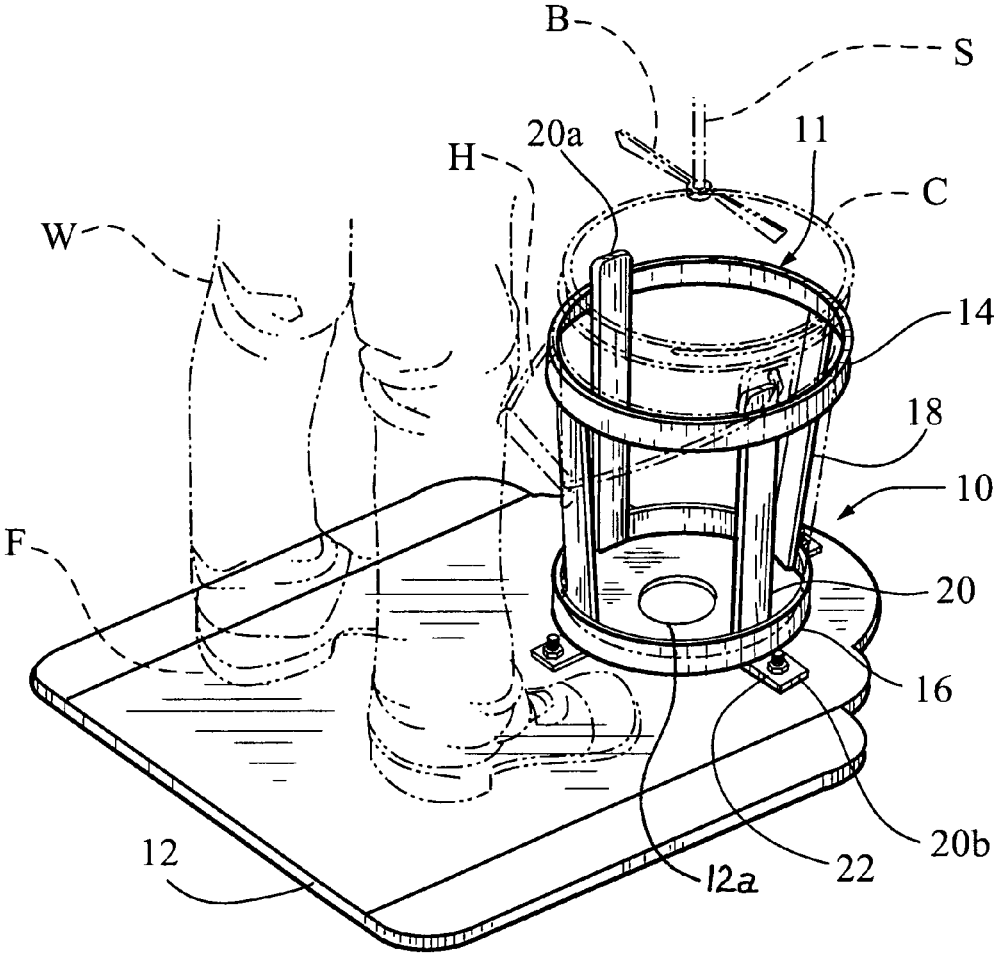
FIG. 1 is a perspective side view from above of a first embodiment of the present mixing stand device shown as intended for use in the mixing of bucketed building material at a worksite.

The following serves to describe a preferred embodiment of the present invention and the best presently contemplated mode of its production and practice. This description is further made for the purpose of illustrating the general principles of the invention but should not be taken in a limiting sense, the scope of the invention being best determined by reference to any associated claims.

Referring to the drawings, the following is a list of structural components of the present mixing stand device, generally designated 10, and those associated structural elements shown employed in connection with the present invention:

10 mixing stand device;
11 frame assembly;
12 base platform;
12*a* platform opening;
14 upper circular band;
16 lower circular band;
18 front and back legs;
18*a* bottom pads;
20 side legs;
20*a* extended tabs;
20*b* bottom pads;
22 nut and bolt fasteners;
30 mixing stand device (alternate embodiment);
31 frame assembly (alternate);
34 upper semi-circular band;
36 lower circular band;
38 front leg;
40 forward support legs;
W worker;
F feet of worker;
C bucket container;
H bucket handle;
P pocket-like cavity;
S mixer shaft; and
B mixer blade.

Referring initially to FIG. 1, the present mixing stand device 10 is shown intended for use by a construction worker W (in phantom outline) in mixing a viscous building material held in a conventional bucket container C (in phantom outline) at a worksite. While the present mixing stand device 10 may well be employed to assist the worker W using either manual or powered mixing means, it particularly benefits the worker in this case using a power drill or other like rotating device (not shown) having an extended mixer shaft S and associated blades B (both in phantom) that may be suspended into the container C and the viscous material therein to apply a controlled torque that mixes the material as necessary. The bucket container C is typically made of a strong but lightweight plastic material formed substantially cylindrical in configuration and having essentially the same diameters, typically between about 11¼ inches at the top and 10¼ at the bottom, in either of the standard three or five gallon sizes. A handle H (shown in phantom) rotatably attached so that it swings across the top of the bucket container C is typically provided and secured to a pocket-like cavity P, shown in phantom outline and better seen in FIGS. 2 and 3. Located beneath the open top of the bucket container C on opposite sides thereof, the pocket-like cavities P are typically formed intermediate of a pair of ring-like edges encircling the container just below the open top. Each pocket-like cavity P is open or slotted at the bottom thereof and found formed having typical dimensions of about 1½ inches in height, about 1¼ to 1½ inches in width, and about ⅜ to ½ inch in the thickness of the slotted opening of the cavity.

In accordance with the present invention, the mixing stand device 10 comprises a rigid frame assembly 11 constructed and attached upon a base platform 12 in a position that allows the worker W to stand with his feet F upon the platform just forward of the frame assembly. The base platform 12 is made from a rigid, lightweight material, such as wood or plastic, and is formed in a substantially rectangular configuration forward of the attached frame assembly 11 with a contoured configuration at the head of the platform around and to the rear frame assembly, as better seen in FIG. 4, follows the curvature of the frame assembly. Forward of the attached frame assembly 11, the length and width of the base platform should be sufficient to position both feet F of the worker W completely on the platform just in front of the frame assembly structure as shown in FIG. 1. A circular opening 12*a* made though the base platform 12 at a position immediately beneath the attached frame assembly 11 is provided to assist in cleaning up any remnants of the building material that may be spilled or otherwise deposited after mixing.

Figure 2:
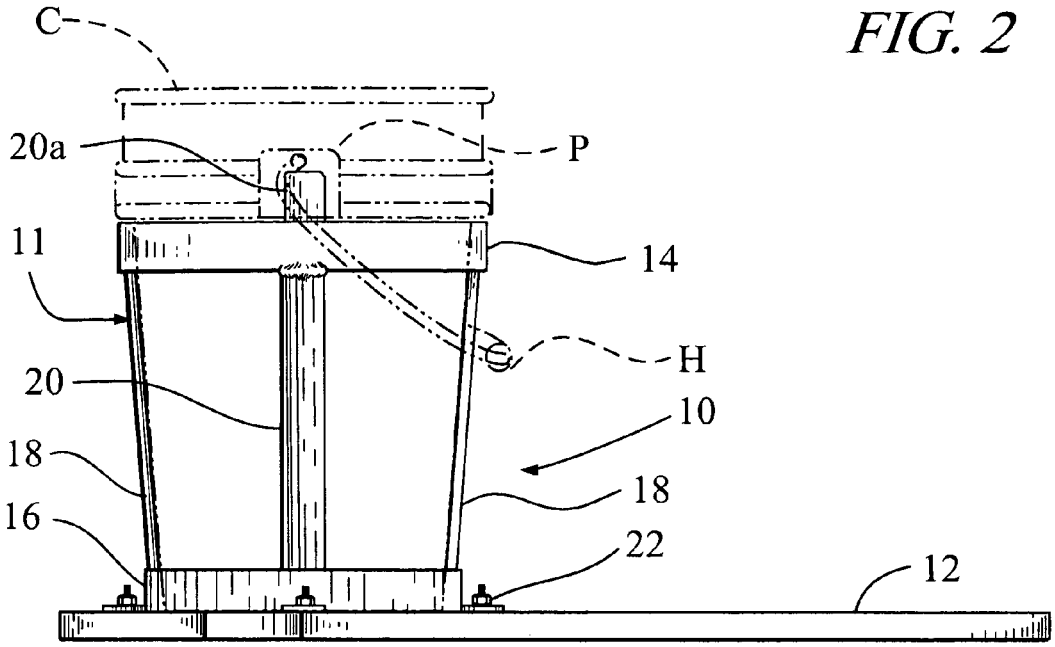
FIG. 2 is a side elevation view of the mixing stand device of FIG. 1 shown with the bucket container (in phantom) in fully engaged position upon the device.
Figure 3:
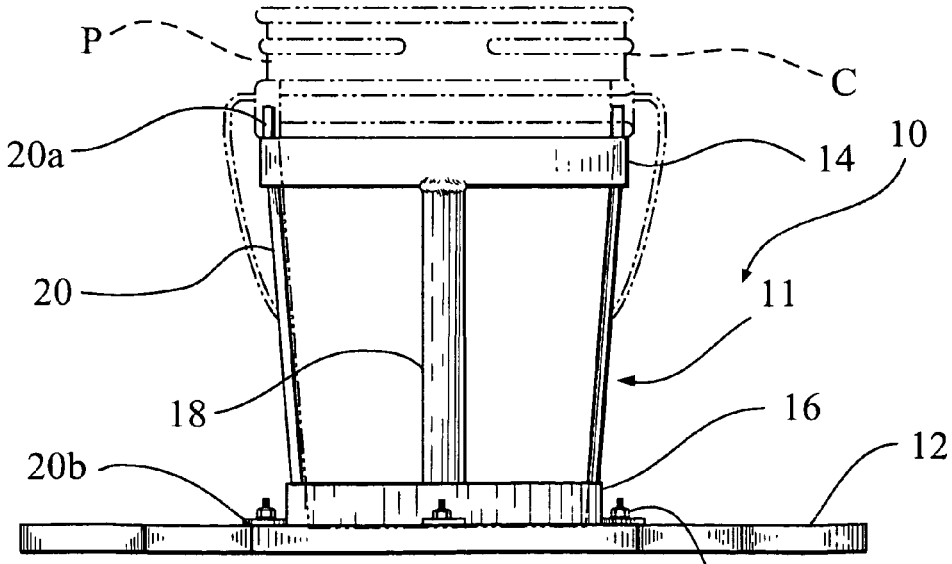
FIG. 3 is a further side elevation view of the mixing stand device of FIG. 1 viewed from the back side thereof.
Figure 4:
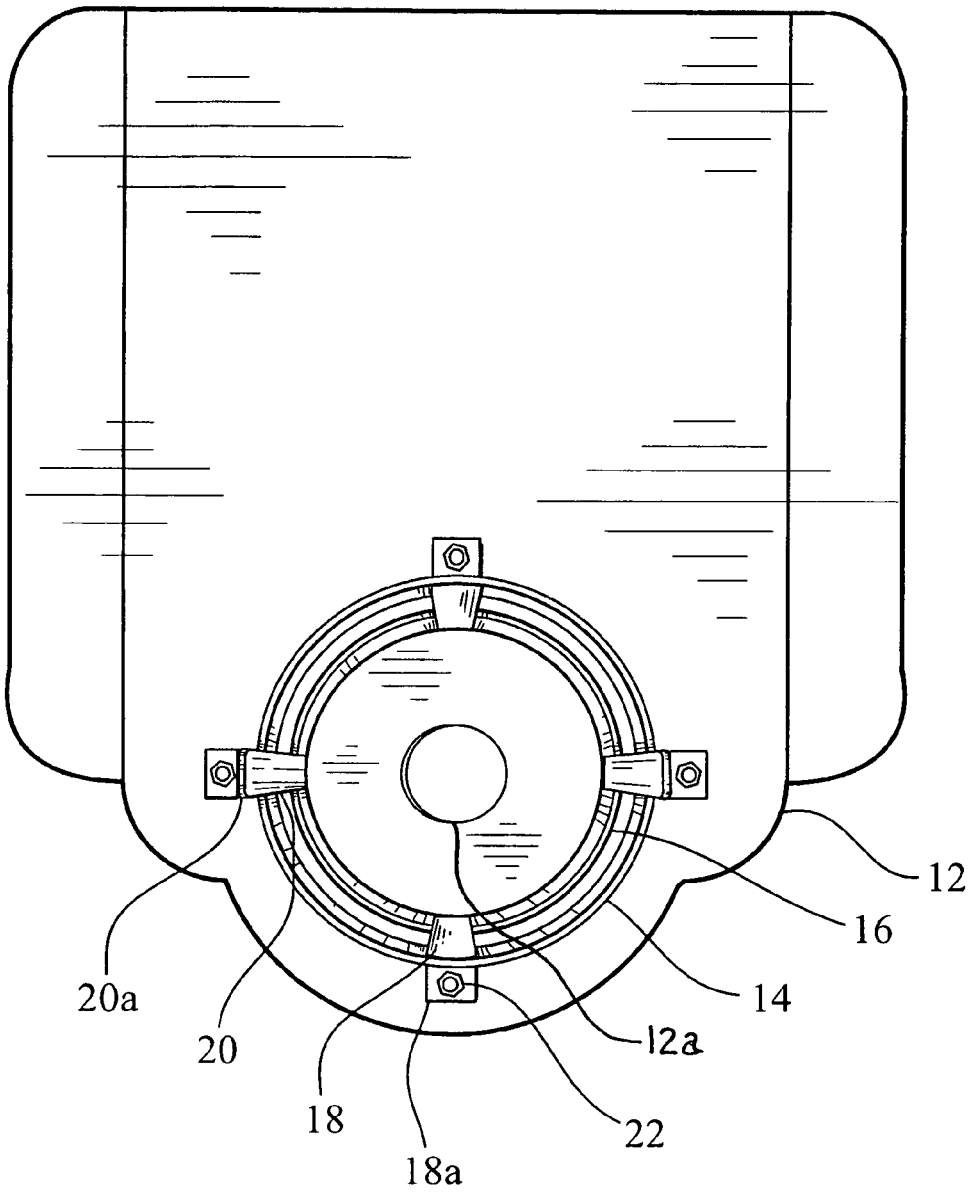
FIG. 4 is a top plan view of the present mixing stand device of FIG. 1.

Referring now to FIGS. 2-4 in conjunction with FIG. 1, the frame assembly 11 is formed having an inwardly tapered cylindrical configuration that is sized and fitted to receive the bucket container C into the open top end of the frame assembly. The frame assembly 11 comprises an upper circular band member 14 and a separate lower circular band member 16 that are spaced apart and coaxially disposed at the respective top and bottom of the frame assembly. The diameter of the upper band member 14 is made to be slightly larger, typically about ½ inch, than that of the lower band member 16 to establish the slight inward taper from top to bottom of the frame assembly 11. Separate front and back leg members 18 are made to extend longitudinally between the lower and upper circular band members 16 and 14, respectively, in positions about 180° apart and each leg member is attached securely at the top and bottom thereof to the respective upper and lower band members. A bottom pad 18*a* at the base of each of the front and back leg members 18 is formed at a right angle to the respective lengths so that each pad may project radially outward from the lower band member 16 with each pad being provided further with an opening therethrough that permits mechanical attachment to the base platform 12 as described below in greater detail.

A pair of side leg members 20 are further disposed on opposite lateral sides of the frame assembly 11, and like the front and back leg members 18, each side leg member is made to extend longitudinally between the lower and upper circular band members 16 and 14, respectively, but positioned about 90° apart relative to the front and back leg members. The side leg members 20 are each attached at the top and bottom thereof to the respective upper and lower circular band members 14 and 16 like the front and back leg members 18, and are similarly provided with a bottom pad 20*b* at the base of each side leg that is formed at a right angle to their respective lengths so that each bottom pad may project radially outward from the lower band member 16. Each bottom pad 20*b* of the side leg members 20 is further provided with an opening therethrough that permits mechanical attachment to the base platform 12 by means of nut and bolt fasteners 22 described below.

The side leg members 20 are further formed having an extended tab 20*a* projecting above the upper band member 14. Located at opposite lateral positions on the frame assembly 11, each extended tab 20*a* is intended to align with and engage the pocket-like cavity P on either side of the bucket container C when the container is seated within the frame assembly, as best seen in FIGS. 2 and 3. Each tab 20*a* is made to extend above the top edge of upper band member 14 a sufficient height dimension, typically about one inch, to penetrate the pocket-like cavity P without impact or interference with the working handle H and its attachment therein. The width and thickness of the extended tabs 20*a* are each made slightly smaller than the associated dimensions of the pocket-like cavity P to allow the tabs to fit snugly therein. Each tab 20*a* may be further rounded on its top edge and corners to reduce its sharpness and ease the engagement with the pocket-like cavity P and its removal therefrom. It should be therefore understood that with the bucket container C properly seated within the frame assembly 11 and the tabs 20*a* engaged within the pocket-like cavities P on opposite sides, as shown in FIGS. 2 and 3, torque upon the container that is caused by the rotational mixing of the viscous material therein is resisted and the stationary position of the container is maintained for more effective mixing of the material.

All members comprising the frame assembly 11 are fabricated from a strong and relatively hard yet malleable metal or metal alloy, such as, for example, carbon steel that is surface treated or coated to increase its corrosion resistance, and those attachments described between each of the respective members of the frame assembly are preferably made by conventional welding. Nut and bolt fasteners 22 or other like members for mechanically connecting abutting parts are fitted through corresponding holes made though the base platform 12 about 90° apart and secured between the bottom pads 18*a* and 20*b* on front and back leg members 18 and side legs 20, respectively, and the abutting base platform to secure the frame assembly 11 in place upon the platform.

Figure 5:
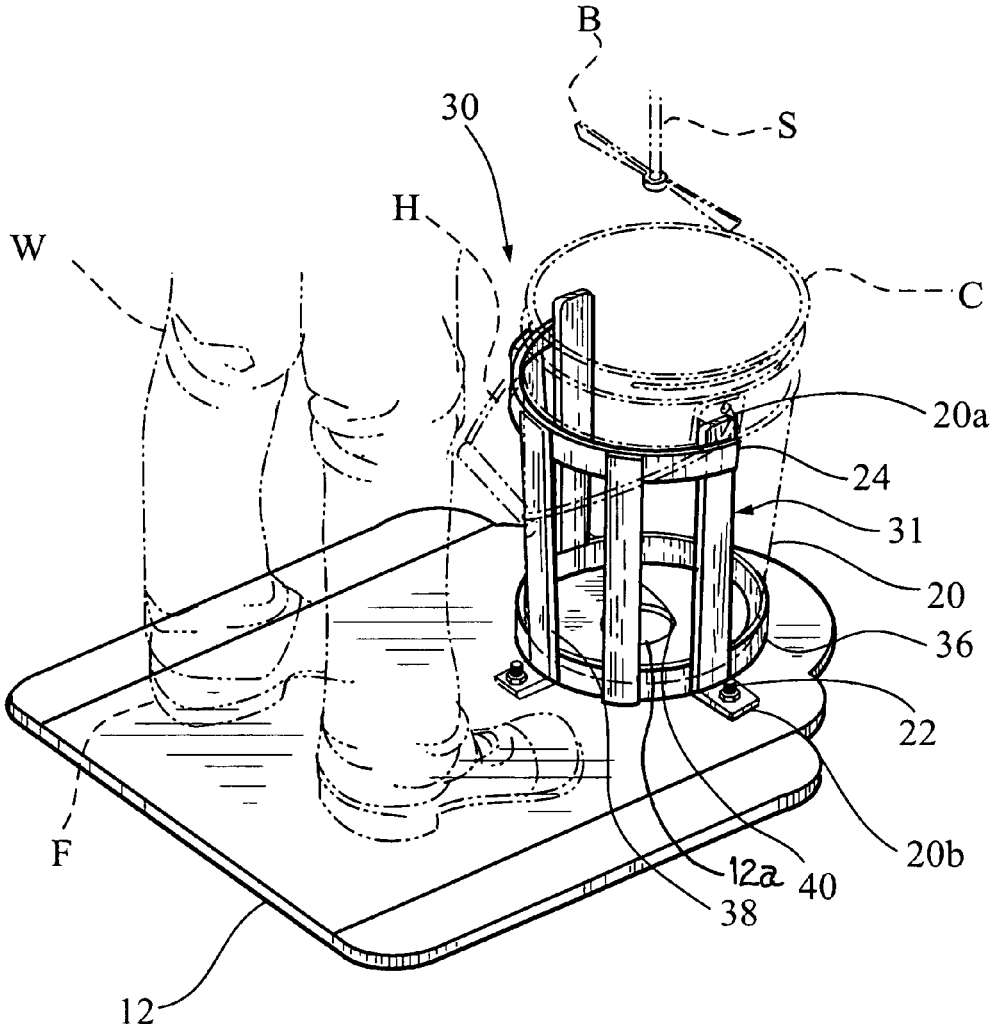
FIG. 5 is a perspective side view from above of a second embodiment of the mixing stand device according to the present invention shown as intended for use in the mixing of bucketed building material at a worksite.

Referring now to FIG. 5, an alternate embodiment of the present mixing stand device, generally designated 30, includes a modified frame assembly 31 wherein a semi-circular upper band member 34 is formed and assembled at the top of the frame assembly to facilitate movement of the bucket container C to and from the frame assembly particularly when the container is especially heavy and filled with the viscous material. The modified frame assembly 31 is similarly disposed to that of frame assembly 11 and is attached upon base platform 12 in a position that allows the worker W to stand with his feet F upon the platform just forward of the frame assembly as it is used to hold the conventional bucket container C in a proper stationary position most effective for mixing a viscous building material in the container with a powered mixer having an extended shaft S and associated mixer blades B. The bucket container C held and secured in the present mixing stand device 30 is that same conventional type as described above having the same general cylindrical configuration with a working handle H rotatably attached and secured to pocket-like cavities P on opposite sides.

Figure 6:
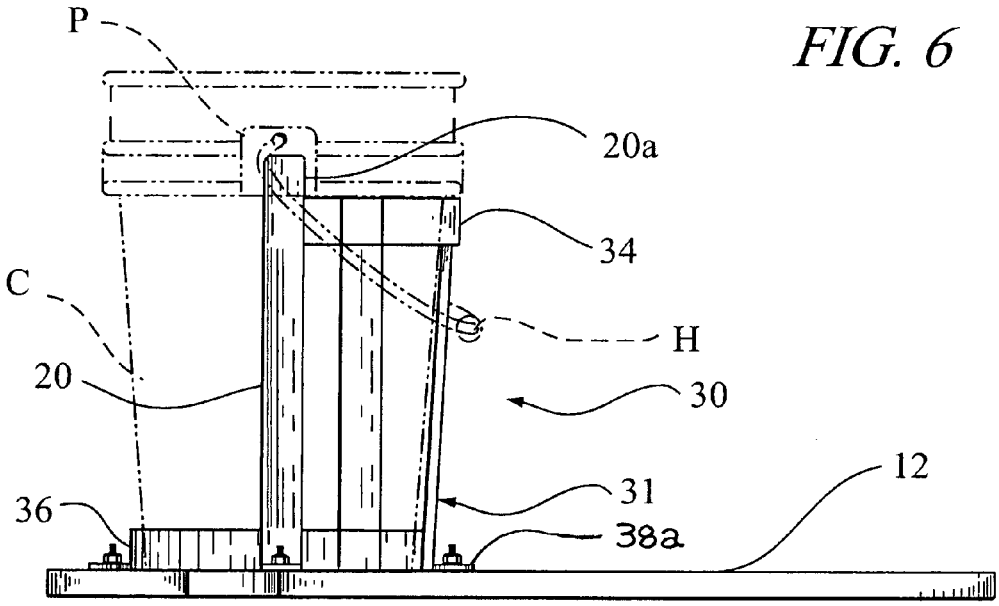
FIG. 6 is a side elevation view of the mixing stand device of FIG. 5 shown with the bucket container (in phantom) in fully engaged position upon the device.
Figure 7:
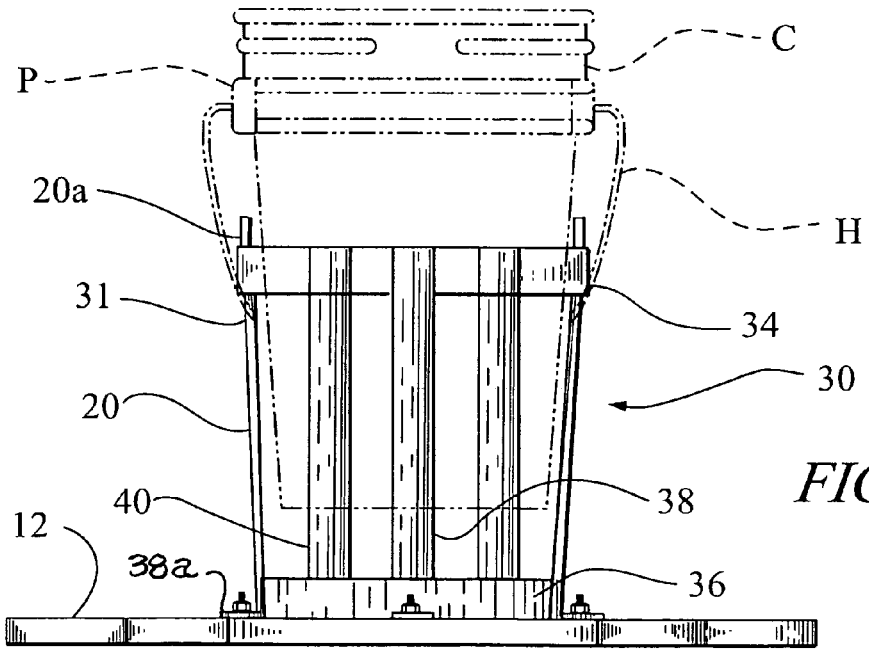
FIG. 7 is a further side elevation view of the mixing stand device of FIG. 5 shown with the bucket container (in phantom outline) partially engaging the device.

Referring now to FIGS. 6 and 7 in conjunction with FIG. 5, the modified frame assembly 31 is similarly formed to frame assembly 11 with an inwardly tapered cylindrical configuration that is sized and fitted to receive the bucket container C into the open top end of the modified frame assembly. In addition to the semi-circular upper band 34, the frame assembly 31 further comprises a separate lower circular band member 36, like that of band member 16 that is coaxially disposed apart from the upper band at the bottom of the frame assembly. The diameter of the semi-circular upper band member 34 is slightly larger, typically about ½ inch, than that of the lower band member 36 to establish the slight inward taper from top to bottom of the frame assembly 31. A plurality of separate front leg members 38 are disposed longitudinally and attached between the lower and upper band members 36 and 34, respectively, the plurality of front leg members being employed and spaced apart around the forward portion of the frame assembly 31 to provide added support to the semi-circular upper band member. A bottom pad 38*a* at the base of a central one of the front leg members 38 is formed at a right angle to project radially outward from the lower band member 36 and via an opening therethrough, provides surface attachment of the frame assembly 31 to the base platform 12 using nut and bolt fasteners 22.

Similarly to frame assembly 11, the modified frame assembly 31 includes side leg members 20 disposed on opposite lateral sides of the frame assembly, extending longitudinally between the lower circular band member 36 and the semi-circular upper band member 34 and attached thereto. The side leg members 20 are provided with a bottom pad 20*b* at the base of each side leg that is formed at a right angle to project radially outward from the lower band member 36. Each bottom pad 20*b* is further provided with an opening therethrough for mechanical attachment to the base platform 12 by means of nut and bolt fasteners 22.

The frame assembly 31 further includes a pair of extended tabs 20*a*, one formed at the top of each side leg member 20 to project above the upper band member 34 at opposite ends of its semi-circular configuration. Like those in frame assembly 11, each extended tab 20*a* in the modified frame assembly 31 is intended to align with and engage the pocket-like cavity P on either side of the bucket container C when the container is properly seated within the frame assembly, as best seen in FIG. 6. Each tab 20*a* extends above the top edge of the upper band member 34 a sufficient height dimension, typically about one inch, to penetrate the pocket-like cavity P without impact or interference with the working handle H and its attachment therein. The width and thickness of the extended tabs 20*a* are each made slightly smaller than the associated dimensions of the pocket-like cavity P to allow the tabs to fit snugly therein. The tabs 20*a* may be further rounded on their top edge and corners to reduce their sharpness and ease their engagement with the pocket-like cavity P and removal therefrom. As seen in FIG. 7, the bucket container C need not be lifted above the semi-circular upper band 34 and into the modified frame assembly 31, as in the case of frame assembly 11, but rather need be raised only above the height of the lower band member 36 in order to align and engage the extended tabs 20*a* with the pocket-like cavities P and properly seat the bucket container within the described alternate embodiment of the present mixing stand device 30.

Therefore, it is apparent that the described invention provides an improved bucket-retainer device for allowing a construction worker to safely and effectively mix all types of viscous building materials as needed for proper application of the materials at a worksite. More particularly, the disclosed invention provides a mixing stand device for holding a bucket container of viscous building material in a safe and stationary position that resists the torque caused by power mixing so that a worker may effectively mix the material in the bucket as needed. In the described embodiments, the present mixing stand device safely positions a conventional bucket container on a worksite secured against rotation so that building material within the container may be effectively mixed by a worker with a powered mixing unit. Furthermore, the present mixing stand device is portable and readily moved around a worksite and is easy to implement by a worker. In addition, the disclosed mixing stand device is safe and simple to use, rugged in construction and inexpensive to maintain.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Furthermore, certain modifications to the described embodiment that serve to benefit its usage are within the scope of the present invention. Accordingly, it is understood that this invention is not limited to the particular embodiment described, but rather is intended to cover modifications within the spirit and scope of the present invention as expressed in the appended claims.

What is claimed is:

1. A mixing stand device for assisting a worker in mixing a viscous material in a conventional bucket container of the type having open cavities integrally formed on opposite sides thereof, consisting of:

a frame assembly rigid in construction and erected having an inwardly tapered cylindrical configuration from top to bottom of said assembly fitted to receive the bucket container in an upright position, the frame assembly including a set of upper and lower circular band members, each of the band members being rigid in form, non-adjustable, and coaxially disposed and spaced apart in elevation at the respective top and bottom of the frame assembly, and a plurality of leg members each fixed in length and connected between the circular band members and disposed in pairs on opposite sides of said frame assembly, at least one pair of the leg members each being formed having an extended tab projecting above the upper circular band member to align with and engage the open cavities on the bucket container when the container is seated within the frame assembly; and a platform rigid in form and attached to and across the bottom of said frame assembly, said platform being sized and configured to permit the worker to stand thereon with both feet forward of said frame assembly.

2. A mixing stand device according to claim 1, wherein said platform is provided with an opening made therethrough positioned immediately beneath said frame assembly to assist in cleaning up the viscous material after mixing.

3. A mixing stand device for assisting a worker in mixing a viscous material in a conventional bucket container of the type having open cavities formed on opposite sides of the container in association with a working handle, consisting of:

a frame assembly rigid in construction and erected having an inwardly tapered cylindrical configuration from top to bottom of said assembly fitted to receive the bucket container in an upright position, said frame assembly including a first band member rigid and circular in form at the bottom of said frame assembly, a second band member rigid and semi-circular in form and coaxially disposed relative to the first band member at the top of said frame assembly, and a pair of leg members each fixed in length and connected between the first and second band members and disposed on opposite sides of said frame assembly, the leg members each being formed having an extended tab projecting above the second band member to align with and engage the open cavities on the bucket container when the container is seated within the frame assembly; and a base platform rigid in form and attached to and across the bottom of said frame assembly, said platform being sized and configured to permit the worker to stand thereon with both feet forward of said frame assembly.

4. A mixing stand device according to claim 3, wherein said platform is provided with an opening made therethrough positioned immediately beneath said frame assembly to assist in cleaning up the viscous material after mixing.

* * * * *